US008840177B2

(12) United States Patent
Ballard et al.

(10) Patent No.: US 8,840,177 B2
(45) Date of Patent: Sep. 23, 2014

(54) PORTABLE OBJECT CATCHER FOR INFANT CHAIRS

(76) Inventors: Kim Ballard, Yucaipa, CA (US); Nolan Ballard, Yucaipa, CA (US)

( * ) Notice: Subject to any disclaimer, the term of this patent is extended or adjusted under 35 U.S.C. 154(b) by 52 days.

(21) Appl. No.: 13/463,958

(22) Filed: May 4, 2012

(65) Prior Publication Data

US 2012/0286546 A1 Nov. 15, 2012

Related U.S. Application Data

(60) Provisional application No. 61/483,791, filed on May 9, 2011.

(51) Int. Cl.
*A47D 15/00* (2006.01)

(52) U.S. Cl.
CPC ..... *A47D 15/00* (2013.01)
USPC ..... 297/182

(58) Field of Classification Search
CPC ..... A47C 1/04; A47C 1/11; A47C 7/62; A47D 1/008
USPC ..... 297/182, 463.1, 174, 134, 174 C, 134 S; 472/15
See application file for complete search history.

(56) References Cited

U.S. PATENT DOCUMENTS

| | | | | | |
|---|---|---|---|---|---|
| 837,570 | A | * | 12/1906 | Jackson | 297/182 |
| 1,050,205 | A | * | 1/1913 | Conley | 297/182 |
| 1,309,343 | A | * | 7/1919 | Thomas | 297/182 |
| 1,377,860 | A | * | 5/1921 | Thomas | 297/182 |
| 2,540,685 | A | | 2/1951 | Mayer | |
| 2,585,434 | A | * | 2/1952 | Caponera | 297/182 |
| 2,938,574 | A | | 5/1960 | Brown | |
| 4,094,547 | A | * | 6/1978 | Zampino et al. | 297/182 |
| 4,165,123 | A | | 8/1979 | Hutson | |
| 4,483,895 | A | | 11/1984 | Deaver | |
| 4,659,143 | A | | 4/1987 | MacLennan | |
| 5,188,421 | A | * | 2/1993 | Arseneault | 297/182 |
| 5,211,607 | A | * | 5/1993 | Fermaglish et al. | 472/15 |
| 5,660,432 | A | | 8/1997 | Davis | |
| D395,623 | S | * | 6/1998 | Yang | D12/133 |
| 6,532,595 | B1 | * | 3/2003 | Holmes | 2/48 |
| 7,717,504 | B2 | * | 5/2010 | Centracco et al. | 297/136 |
| 7,891,731 | B2 | * | 2/2011 | O'Toole | 297/182 |
| 8,122,527 | B2 | * | 2/2012 | Ruttler | 4/484 |
| 2002/0037387 | A1 | | 3/2002 | Sweeney et al. | |
| 2008/0185880 | A1 | | 8/2008 | Romaniuk | |
| 2008/0185881 | A1 | | 8/2008 | Romaniuk | |
| 2009/0127917 | A1 | | 5/2009 | Foenander | |

* cited by examiner

*Primary Examiner* — Jose V Chen

(57) ABSTRACT

An infant high chair catch apparatus comprises a body adapted to be secured to an infant high chair and to provide a relatively planar surface surrounding the chair that prevents objects dropped from the high chair from falling onto the floor or other surface on which the high chair is located. A flexible support frame provides a bias force to maintain the body portion in an extended configuration, and the body is coupled to the chair via support struts. In some embodiments a support strut is attached to each of the legs of a high chair. The apparatus can further comprise a collar that can be cinched up against the chair. The apparatus can be fashioned of waterproof or water resistant material to prevent liquids from contacting the surface below the chair.

20 Claims, 2 Drawing Sheets

PORTABLE OBJECT CATCHER FOR INFANT CHAIRS

CROSS REFERENCE TO RELATED APPLICATION

This application claims the benefit under 35 U.S.C. §119(e) of U.S. Provisional Application No. 61/483,791, filed May 9, 2011, and entitled "Portable Object Catcher for Infant Chairs", the entirety of which is hereby incorporated by reference.

FIELD OF THE INVENTION

The field of the invention relates to accessories for infant chairs, and in particular, devices for catching objects that fall from an infant chair.

BACKGROUND

Small children are typically seated in infant chairs when eating or drinking, or even at times when a parent or other caregiver wishes to have the child seated for reasons of safety. The infant chair thus provides a measure of independence for an infant and allows them to manipulate objects as they learn how to feed and drink on their own, or as they practice in manipulating objects like toys, all in a somewhat controlled environment.

Chairs like high chairs have been traditionally designed with trays upon which food, beverages, toys or other objects may be placed within reach of the child. A nearly universal limitation of prior art infant chair designs is that children can drop objects from the tray area. This can either be due to lack of facility with handling objects, accidental, or in some cases deliberately as the child explores their environment and the consequences of moving objects off of the tray. The result is that food, liquids, and other materials invariably end up on the floor resulting in the need to clean the area under the child's chair. Similarly, if there are concerns about the cleanliness of the floor, toys and other objects are often cleaned before giving them back to the child.

There are a number of prior art attempts to address the problem of materials and objects falling from high chairs. One simple solution, as in U.S. Pat. No. 4,483,895 (Deaver), or U.S. Patent Publication 2002/0037387 (Sweeney et al.), has been to provide an absorbent pad or mat to protect the area beneath a high chair.

Another approach has been to modify the chair, for example, by extending the area of the tray portion. U.S. Pat. No. 2,540,685 (Mayer) discloses an attachment that is secured to the tray of a high chair, extending the front and sides of the tray to limit the ease with which objects may fall from the tray. Similarly, U.S. Pat. No. 4,165,123 (Hutson) discloses a disposable high chair apron adapted to cover and enlarge a high chair eating tray.

In other cases, the prior art solutions comprise various trough-like devices that are intended to catch objects or material falling from the tray. For example, U.S. Pat. No. 2,938,574 (Brown) discloses a "trough" device comprising stiffened panels that attaches to a chair and surrounds it on three sides. The device is limited however, in that it uses the back of the chair and the footrest, in cooperation, to support the trough member. Furthermore, it makes use of multiple stiffening members to provide rigidity, making it complicated to manufacture, and awkward to fold and store. Furthermore, since the device makes use of the chair back and footrest for stability, it is not necessarily adaptable to chairs of different sizes and configurations.

U.S. Pat. No. 4,659,143 does away with a the high chair all together, disclosing a food catcher comprising a seat and frame that attaches directly to a table and provides a catcher that hangs under the child and seat.

Another approach is to provide one or more catching members that partially surround the chair at or below the level of the seat. For example, U.S. Pat. No. 5,660,432 (Davis) discloses an attachable rectangular tray that can be attached to the legs on a side of a high chair. U.S. Patent Publications 2008/0185880 and 2008/0185881 (Romaniuk) discloses an infant food and debris catcher that functions to catch small items or food spilled in the area of the child's seat or legs. US Patent Publication 2009/0127917 (Foenander) discloses a high chair net assembly that wraps around the back and sides of a high chair and which is attached to the chair by hangars.

These prior art solutions to the problem all suffer from one or more problems, including lack of portability, difficulty in assembly, and lack of coverage around the entire infant high chair.

SUMMARY OF THE INVENTION

Various objects, features, aspects and advantages of the inventive subject matter will become more apparent from the following detailed description of preferred embodiments, along with the accompanying drawing figures in which like numerals represent like components.

It is an object of the present invention to provide an apparatus configured to catch objects that fall from an infant high chair. These objects may include food, toys, or any other object that are provided to an infant seated in the chair, or placed within reach of an infant, and which the infant may drop or cause to fall. It is another object of the present invention to provide a portable, easy to install, and lightweight apparatus configured to catch objects that fall from an infant high chair, or which are drop by an infant seated in the chair.

In one embodiment the invention comprises a body comprising a surface upon which objects fall. The body further comprises means for coupling to the chair in order to support the body and maintain it in place during use. When in use the body is in a generally extended configuration that forms a plane substantially parallel to the surface on which the chair is located, and extending outwards from the chair.

Objects are thus prevented from hitting the ground or floor surface on which the chair is situated. In some embodiments the means of coupling the body to the chair further comprise struts that can be mounted on one or more legs of the chair. In some embodiments struts are coupled to chair legs above the plane formed by the body. In some embodiments struts are coupled to chair legs below the plane formed by the body.

In some embodiments the body further includes a collar that can be cinched up against the legs of the infant chair in order to reduce the size of the opening in the center of the apparatus In some embodiments, the body can be constructed from flexible and/or waterproof material in order to prevent liquids from falling on the areas surrounding the chair. In some embodiments the apparatus is constructed of washable materials to make cleaning easier. In some embodiments the body and collar comprise absorbent materials to prevent liquids that fall on the apparatus from wetting the area below the infant chair.

Thus, the invention provides an infant chair catch apparatus for catching objects that fall from an infant chair, the apparatus comprising: a body, the body configured to project generally horizontally outward from, and substantially surrounding the perimeter of the infant chair, wherein the body further comprises an aperture through which the infant chair can pass; at least one bias member located substantially along the perimeter of the body, wherein the bias member is configured to exert a bias force on the body such that the body is maintained in a generally extended planar configuration; and support means, configured to couple the body to at least one location on the infant chair.

In some embodiments the body comprises at least one of a water resistant or a waterproof material.

In some embodiments the support means comprises at least one strut, wherein the at least one strut is configured to couple the body to the at least one location on the infant chair. In some embodiments the at least one strut is reversibly coupled to the body and the at least one location on the infant chair. In some embodiments the at least one strut is coupled to the at least one location on the infant chair by a chair attachment means. In some embodiments the chair attachment means comprises a self-securing loop adapted to reversibly encircle and engage a member on the infant chair.

In some embodiments the invention further comprises a collar, wherein the collar is configured to cooperate with the support means to secure the body to the at least one location on the infant chair, and wherein the collar is further configured to reduce the size of the aperture. In some embodiments the collar further comprises a collar closure, the collar closure adapted to reversibly reduce the size of the aperture. In some embodiments the at least one location on the infant chair comprises a leg of the chair.

The invention further provides a method of catching objects that fall from an infant chair, the method comprising the steps of: providing a body, the body configured to project generally horizontally outward from, and substantially surrounding the perimeter of the infant chair, wherein the body further comprises an aperture through which the infant chair can pass; providing at least one bias member located substantially along the perimeter of the body, wherein the bias member is configured to exert a bias force on the body such that the body is maintained in a generally extended planar configuration; and providing support means, configured to couple the body to at least one location on the infant chair.

In some embodiments the method further comprises providing a body comprising at least one of a water resistant or a waterproof material.

In some embodiments of the method the support means comprises at least one strut, wherein the at least one strut is configured to couple the body to the at least one location on the infant chair. In some embodiments the at least one strut is reversibly coupled to the body and the at least one location on the infant chair.

In some embodiments the method further comprises providing chair attachment means adapted to couple the strut to the infant chair. In some embodiments of the method the at least one strut is coupled to the at least one location on the infant chair by a chair attachment means. In some embodiments the chair attachment means comprises a self-securing loop adapted to reversibly encircle and engage a member on the infant chair.

In some embodiments the method further comprises providing a collar, wherein the collar is configured to cooperate with the support means to secure the body to the at least one location on the infant chair, and wherein the collar is further configured to reduce the size of the aperture. In some embodiments the collar further comprises a collar closure, the collar closure adapted to reversibly reduce the size of the aperture. In some embodiments the at least one location on the infant chair comprises a leg of the chair.

In some embodiments the method further comprises positioning the infant chair catch such that the body portion forms a substantially planar surface, and wherein the body of the apparatus has an outer edge and an inner edge, and wherein the outer edge is positioned at an elevation higher than the inner edge, such that the planar surface of the body is inclined with respect to the vertical axis of the infant chair.

BRIEF DESCRIPTION OF THE DRAWINGS

While the invention is claims in the concluding portions hereof, preferred embodiments are provided in the accompanying detailed description which may be best understood in conjunction with the accompanying diagrams where like parts in each of the several diagrams are labeled with like numerals, and where:

DETAILED DESCRIPTION

The following discussion provides examples of embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed. Those of skill in the art will recognize that the described embodiment are examples of possible configurations of the invention, and are not intended to be limiting to the scope of the invention. Accordingly, the drawings and descriptions contained herein are to be regarded as illustrative of the invention as set forth in the accompanying claims.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

Figure 1:
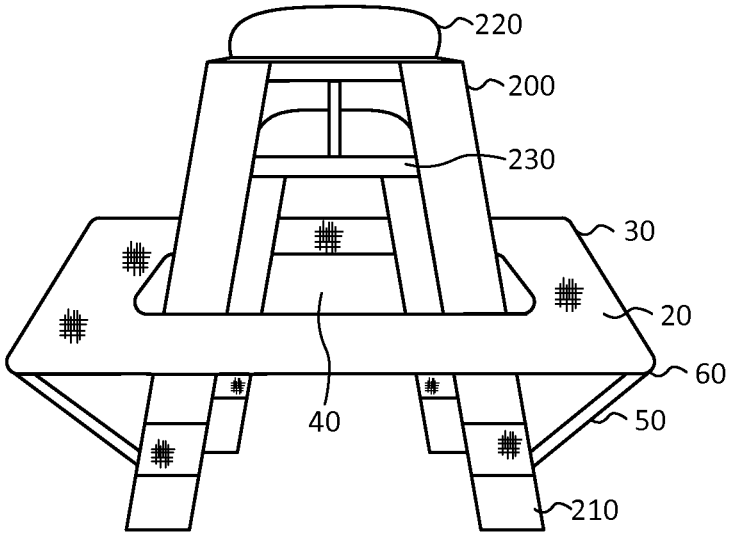
FIG. 1 is front perspective view of an embodiment of the present invention, installed on an infant high chair.
Figure 2:
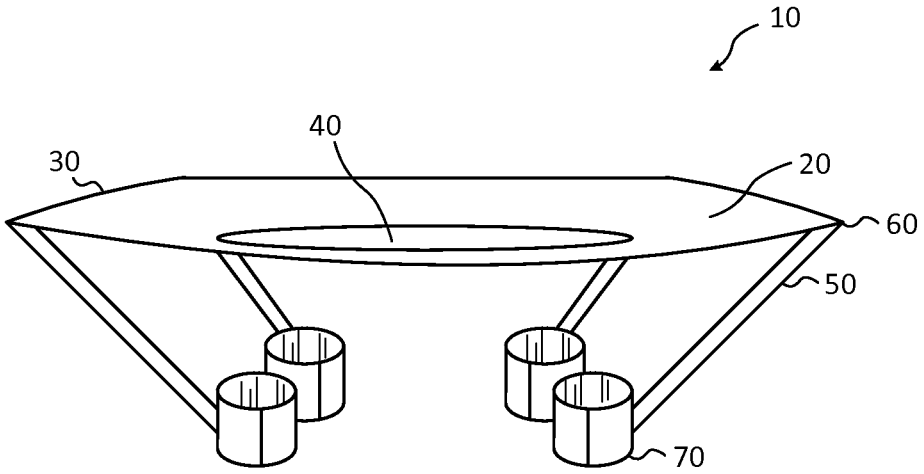
FIG. 2 is a perspective view of an embodiment of the present invention, separate from an infant high chair.
Figure 3:
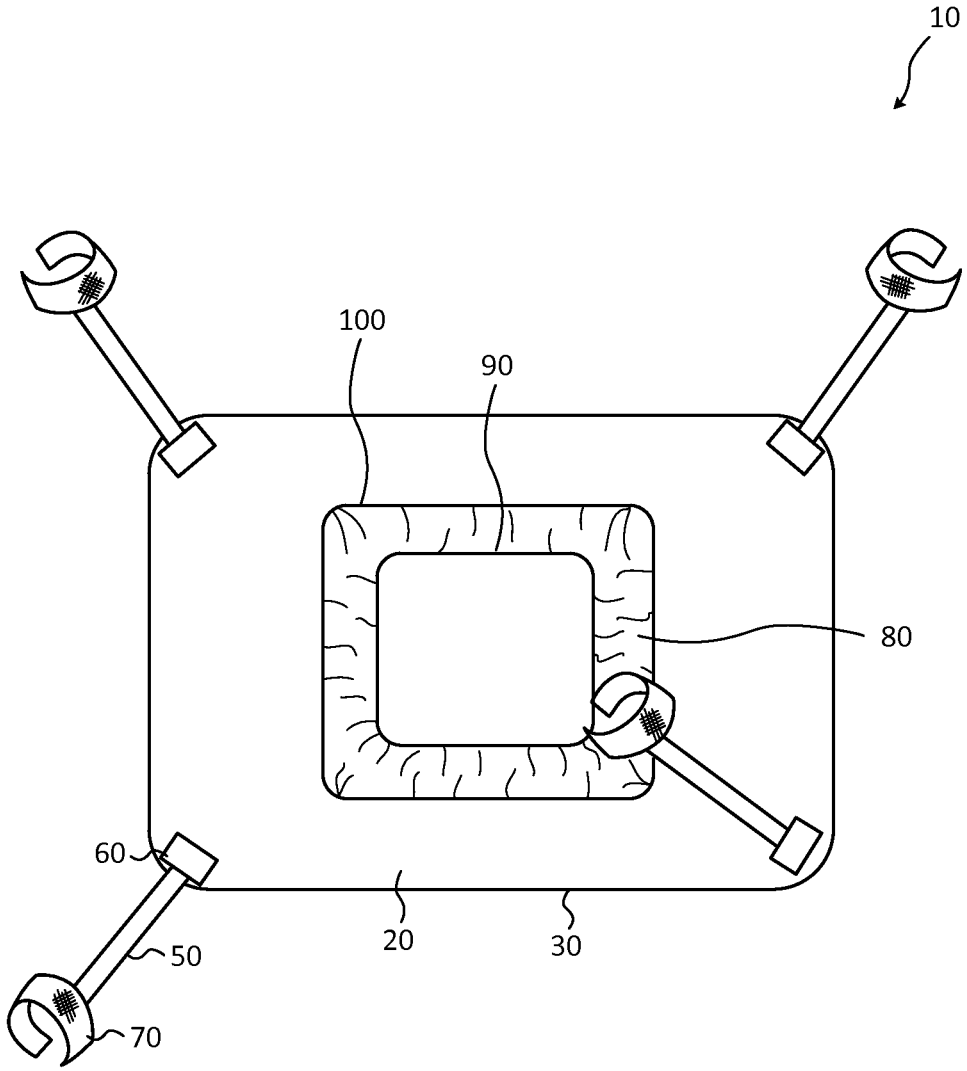
FIG. 3 is a bottom view of an embodiment of the present invention.

FIGS. 1-3 depict examples of embodiments of the present invention of a high chair catch 10 configured to be secured to an infant high chair 200, the high chair further comprising a plurality of legs 210, a back 220 and a seat 230. The high chair catch 10 comprises a body 20, a body support member 30, an opening 40 in the body, at least one support strut 50, a body attachment 60 connecting a strut to the body, and at least one chair attachment 70. In some embodiments the body comprises a lightweight, flexible and/or waterproof or water resistant material. A support strut 50 can be either permanently attached to the body via the body attachment, or may be removable attached. For example, a body attachment 60 may comprise a sewn pocket adapted to receive a substantially rod-shaped strut.

In some embodiments, and as shown in FIGS. 1-3 inclusive, the body may further comprise a body support member 30. The body support member is adapted to provide additional rigidity substantially around the circumference of the body and to improve the ability of the body to resist deformation when objects land on it. In some embodiments, the body support member comprises a flexible wire secured to the outer edge of the body. In order to secure the body support member to the body of the high chair catch, the member can be sewn into a seam along the outer edge of the body so that it is maintained in place. In other cases, the body support member may be secured by an arrangement of loops with quick-release closures located at substantially regular positions along the outer edge of the body, like those well known in the art of tents and tarpaulins (See for example the quick acting closures of U.S. Pat. No. 4,077,418, which are hereby incorporated by reference herein).

Preferably the body is constructed of a lightweight, flexible material. It may also be desirable that the body is waterproof or at least water resistant so that liquids do not flow directly off the body onto the surface on which the high chair is located. Alternatively, the body may comprise an absorbent material capable of quickly absorbing liquids that may fall onto the catch before they have a chance to spill off the catch onto the floor. The body support member is preferably fashioned from a single piece of a spring-like material with a tendency to adopt an extended conformation. The body support member can then be constrained generally within the outer edge of the body. In some embodiments this can be accomplished by sewing the body support into an edge seam that substantially runs the entire perimeter of the body portion. Appropriate methods of securing the body support member to the body will be well known to those of skill in the art and are not considered limiting to the scope of the invention. Such methods can include as discussed, loops or seams, but may include other methods such as snaps, ties, hooks, or any other suitable structure and method of attachment.

As the body support member will generally prefer an extended conformation, by constraining the body support member into a generally circular configuration within the outer edge of the body, a bias force will be produced by the support member that will operate to maintain the body portion of the high chair catch in a relatively extended, planer configuration. In addition, the tendency of the body support member to adopt such an extended configuration will cause sufficient tension in the body such that it will resist deformation when an objects fall from the infant chair onto the high chair catch. Further, the body support member being generally resistant to deformation will cooperate with other features of the invention to help maintain the body in an extended configuration, even when an object falls onto it.

Elevating the body of the catch provides an additional advantage in that objects can be more easily picked up and returned to the infant or the chair tray than would be the case if the object were on the floor or other surface. In addition, given the objects are kept off the floor or surface means a user such as a parent can be assured that the items remains relatively clean, which would not the case if the object had fallen on the floor.

The body of the high chair catch further comprises an opening 40 that is useful in allowing the user to place the high chair catch over the chair without the need for any discontinuity along the circumference of the body portion. This is distinct from many prior art devices. While a body portion with a seam might also be useable, the present invention provides a simpler apparatus that is less likely to permit spills of materials as might occur along a seam running from the outer edge of the body to the opening. A split would also require additional fasteners adding to the complexity and cost of producing the catch. Additional components also provide additional points of failure.

In order to provide a more secure closure of the opening, and as shown in FIG. 3, the high chair catch may also comprise a collar 80. The collar 80 operates much like well-known closures used in seating areas of kayaks that can be drawn up against the user. Here, the collar can be drawn up relatively snugly against the infant high chair in order to minimize the size of the aperture of the opening 40. In some cases, the collar can further comprise a collar closure 90 that is used to better secure the collar. In some embodiments, the collar closure can comprise a drawstring, or elastic, or like components to snug the collar to the chair.

In some embodiments, the collar 80 can comprise an absorbent material, and the body 20 can be positioned, as shown in FIG. 2, such that there is a slight incline from the outer edge to the opening 40. One method by which the body portion can be inclined as described is to secure the collar closure against the chair at a height below that of the outer edge of the body. Arranged in this way, liquids that spill onto the body will tend to flow by force of gravity towards the collar where they could be absorbed by the material in the collar.

In some embodiments, the collar may be reversibly attached to the body by a collar attachment 100. In some embodiments the collar attachment may comprise a zipper arrangement that allows the collar to be easily removed from the body, without having to remove the entire apparatus from the chair. Such an arrangement would make it more convenient to wash and dry and absorbent collar. Conveniently, more than one collar could be supplied with the apparatus so that a user would have available a clean spare collar at all times.

In some embodiments, like that shown in FIG. 1 the high chair catch 10 is attached to a high chair in such a way that the body forms a planar surface substantially perpendicular to the vertical axis of the high chair (i.e., substantially parallel to the surface upon which the high chair is situated). In other embodiments, for example as described above and shown in FIG. 2, the body may be positioned such that an incline is created between the outer circumference of the body and the opening. In still other embodiments, it may be preferable to place the apparatus around the high chair in a configuration that is inverted relative to that shown in FIGS. 1 and 2. In such a positioning, the body would hang from the support struts, instead of being held up by them. Depending on the precise type of chair to which the high chair catch is being secured may decide which of these two configurations is most preferable. It should be remember that the high chair catch will operate equally well in either the normal or inverted configuration, and so the choice of how to place the apparatus on a high chair is not considered to be limiting to the scope of the invention.

As mentioned above the body portion is preferably connected to the chair via support struts 50. In some embodiments the apparatus will comprise four support struts spaced relatively evenly around the perimeter of the body portion, such that they will approximately line up with the leg positioning of a high chair. A support strut may be attached permanently or reversibly to the body by a body attachment 60.

In some embodiments, a reversibly mounted strut can be inserted into a pocket or similar engagement structure located along the outer edge of the body, as depicted in FIG. 3. Also shown in FIG. 3 the body attachment 60 may be movable even with the strut 50 engaged, so that positioning of the strut relative to a chair leg is made easier. As an example, the bottom right strut of FIG. 3 has been rotated approximately 180° inwards in order to show an example range of mobility of the strut when attached to the body portion.

A support strut 50 is in turn connected to a portion of the high chair, for example to a high chair leg 210 by way of a chair attachment 70. In some embodiments the chair attachment comprises a loop that substantially encircles a chair leg. A loop type chair attachment 70 can be conveniently secured around a chair leg by means of a Velcro® closure, or other fastening means that are well known in the art, including, but not limited to ties, snaps, clamps and other like devices.

The support strut 50 can be connected to the chair attachment 70 using similar methods as are used for attaching the strut to the body attachment 60. For example, the strut 50 may engage a pocket or similar structure that forms the chair attachment such that when in use the strut is held relatively securely in place. In other embodiments, the strut may be more permanently fixed in place to the chair attachment.

Conveniently, the chair attachment 70 can be attached at virtually any location along the chair leg 210. The flexible nature of the body attachment and chair attachment allows the strut to be positioned easily on chairs with differing spacing between the legs. Alternatively, the flexible nature of the attachment means allows the user to place the high chair catch at various placements up and down the vertical axis of the chair. This, in some cases it may be desirable to place the high chair catch at a point level with the chair set. In other cases it may be useful to place the catch lower down near the footrest typically included in infant high chairs. In yet other instance, it may be preferable to position the catch below where the infant's feet would be, as is depicted in FIG. 1.

Reversibly connecting the strut to the chair and body attachment portions provides an advantage in allowing the apparatus to be broken down for portability. In contrast, some users may desire an apparatus where the struts are relatively permanently attached to the chair and body attachment in order to reduce the risk of loss of pieces of the apparatus during transportation. The present invention permits either configuration to be produced.

Conveniently, the use of support struts obviates the need to attach the apparatus to the seat or back of the high chair as is the case in prior art devices. See for example U.S. Patent Publication 2009/0127917 (Foenander) where a safety net is attached to the side rails and back of a high chair. The present invention also provides a significant improvement over prior art devices that do not provide complete circumferential coverage. For example, U.S. Pat. No. (Davis), which discloses discrete trays located at the sides of a high chair.

The specific materials used in constructing the body, frame, and struts are not considered to be limiting to the scope of the invention. Those of skill in the art will readily recognize and be able to select materials that will maintain the body in a desired position and which will avoid buckling or extensive deformation of the surface upon which objects fall such that the objects are not retained on the body of the high chair catch.

It should also be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. An infant chair catch apparatus for catching objects that fall from an infant chair, for use in combination with the infant chair, the apparatus comprising:

a body, the body configured to project generally horizontally outward from, and substantially surrounding the perimeter of the infant chair, wherein the body further comprises an aperture through which the infant chair can pass;

at least one body support member located substantially along the perimeter of the body, wherein the at least one body support member comprises a flexible, spring-biased member configured to exert a bias force effective to maintain the body in a generally extended planar configuration; and at least one body attachment member configured to couple the body to at least one location on the infant chair.

2. The apparatus of claim 1, wherein the body support member is located within a seam formed along the outer edge of the body.

3. The apparatus of claim 1, wherein the at least one body attachment member comprises at least one strut, wherein the at least one strut is configured to couple the body to the at least one location on the infant chair.

4. The apparatus of claim 3, wherein the at least one strut is reversibly coupled to the body and to the at least one location on the infant chair.

5. The apparatus of claim 4, wherein the at least one strut is coupled to the at least one location on the infant chair by a chair attachment member.

6. The apparatus of claim 5, wherein the chair attachment member comprises a self-securing loop adapted to reversibly encircle and engage a member on the infant chair.

7. The apparatus of claim 1, further comprising a collar, wherein the collar is configured to cooperate with the at least one body attachment member, and the chair attachment member, to secure the body to the at least one location on the infant chair, and wherein the collar is further configured to reduce the size of the aperture.

8. The apparatus of claim 7, wherein the collar further comprises a collar closure, the collar closure adapted to reversibly reduce the size of the aperture.

9. The apparatus of claim 1, wherein the at least one location on the infant chair comprises a leg of the chair.

10. A method of catching objects that fall from an infant chair, the method comprising the steps of:

providing an apparatus configured to catch objects that fall from the infant chair, the apparatus comprising:

a body, the body configured to project generally horizontally outward from, and substantially surrounding the perimeter of the infant chair, wherein the body further comprises an aperture through which the infant chair can pass;

at least one body support member located substantially along the perimeter of the body, wherein the at least one body support member comprises a flexible, spring-biased member configured to exert a bias force effective to maintain the body in a generally extended planar configuration; and at least one body attachment member configured to couple the body to at least one location on the infant chair.

11. The method of claim 10, wherein the body support member is located within a seam formed along the outer edge of the body.

12. The method of claim 10, wherein the at least one body attachment member comprises at least one strut, wherein the at least one strut is configured to couple the body to the at least one location on the infant chair.

13. The method of claim 12, wherein the at least one strut is reversibly coupled to the body and to the at least one location on the infant chair.

14. The method of claim 12, wherein the method further comprises providing a chair attachment member adapted to couple the strut to the infant chair.

15. The apparatus of claim 14, wherein the at least one strut is coupled to the at least one location on the infant chair by the chair attachment member.

16. The method of claim 10, wherein the chair attachment member comprises a self-securing loop adapted to reversibly encircle and engage a member on the infant chair.

17. The method of claim 10, further comprising providing a collar, wherein the collar is configured to cooperate with the at least one body attachment member, and the chair attachment member, to secure the body to the at least one location on the infant chair, and wherein the collar is further configured to reduce the size of the aperture.

18. The method of claim 17, wherein the collar further comprises a collar closure, the collar closure adapted to reversibly reduce the size of the aperture.

19. The method of claim 10, wherein the at least one location on the infant chair comprises a leg of the chair.

20. The method of claim 10, the method further comprising positioning the infant chair catch such that the body portion forms a substantially planar surface, and wherein the body of the apparatus has an outer edge and an inner edge, and wherein the outer edge is positioned at an elevation higher than the inner edge, such that the planar surface of the body is inclined with respect to the vertical axis of the infant chair.

* * * * *